United States Patent [19]

Morrisey, IV et al.

[11] 4,288,315

[45] Sep. 8, 1981

[54] BENEFICATION OF FLUORSPAR ORES

[75] Inventors: John C. Morrisey, IV, Beckley, W. Va.; Ulus R. Smith, Cave-In-Rock, Ill.

[73] Assignee: Allied Corporation, Morris Township, N.J.

[21] Appl. No.: 24,215

[22] Filed: Mar. 26, 1979

[51] Int. Cl.[3] ..... B02B 1/02

[52] U.S. Cl. ..... 209/11; 209/167

[58] Field of Search ..... 209/11, 166, 167

[56] References Cited

U.S. PATENT DOCUMENTS

| | | | |
|---|---|---|---|
| 2,407,651 | 9/1946 | Clemmer | 209/166 |
| 2,497,863 | 2/1950 | Clemmer | 209/166 |
| 3,207,304 | 9/1965 | Thom | 209/167 X |
| 3,430,765 | 3/1969 | Allen | 209/11 |
| 3,536,193 | 10/1970 | Allen | 209/11 |

OTHER PUBLICATIONS

Chem Abst. 65, 1966, 8397g.
Chem. Abst. 66, 1967, 67405s.
Chem. Abst. 69, 1968, 60368k.
Mining Chemicals Handbook, Mineral Dressing Notes, No. 26, Amer. Cyanamid, 1970, pp. III to IV.
A. F. Taggart, Handbook of Mineral Dressing, Ores & Ind'l. Minerals, John Wiley, 1954, pp. 12-35 to 12-36.
Froth Flotation, AIMME, 1962, pp. 157-163.
A. V. Fat'anov et al. in Tsvetn. Metal, 39 (5) 6-8 (1966), Russian Version & Soviet J. of Non-Ferrous Metals, vol. 39 (5) 6-7, 1966, English Version.
L. V. Katashin et al., in Tsvet Metal., 39 (11) 15-17 (1966), Russian Version & Soviet J. of Non-Ferrous Metals, vol. 39 (11) 18-19, (1966) English Version.

*Primary Examiner*—Robert Halper
*Attorney, Agent, or Firm*—Thomas D. Hoffman

[57] ABSTRACT

An improvement is provided in a process for the flotation of an acid grade fluorspar enriched concentrate, having a sulfide sulfur content not greater than about 0.02%, from a fluorspar ore containing in addition to fluorspar substantial amounts of gangue minerals and metallic sulfide accessory minerals. The invention utilizes in this conventional flotation process an alkali metal sulfide, preferably sodium sulfide, as a depressor reagent, in substitution of environmentally objectionable sodium cyanide, to depress the flotation of metallic sulfide minerals, thereby rendering a flotation concentrate low in sulfide sulfur content while substantially reducing associated environmental effects.

3 Claims, No Drawings

BENEFICATION OF FLUORSPAR ORES

BACKGROUND OF THE INVENTION

This invention relates generally to the benefication of fluorspar ores by froth flotation to obtain an acid grade fluorspar concentrate low in sulfur content and specifically to the use of an alkali metal sulfide as a flotation depressor for metallic sulfide accessory minerals.

"Acid grade" fluorspar, a term generally utilized to designate a concentrate containing at least about 96.5 to 97% fluorspar, is used in various chemical processes as a source of fluorine and hydrogen fluoride. The specification as to allowable impurities varies within the industry, but generally it is required that the fluorspar product be relatively free of gangue minerals such as quartz, calcite, and barite and other accessory minerals, especially sulfides such as galena, sphalerite, pyrite, and chalcopyrite. Fluorospar ores as mined seldom meet the specification with respect to fluorspar content or freedom from impurities. Consequently, the ore minerals must be separated by suitable extractive metallurgical processes.

A commonly employed method for the concentrating of acid grade fluorspar entails first froth floating the sulfide minerals from the slurried ore, termed "prefloating", and then froth floating the fluorspar while depressing residual sulfides not removed in the prefloat. In the prefloat circuit, the sulfides are floated typically by xanthates in combination with copper sulfate. After prefloat, the ore slurry, having a substantially reduced sulfide content, is ready for fluorspar flotation. In the fluorspar circuit, the fluorspar is floated by an anionic collector, such as a fatty acid, in the presence of gangue depressors, a sulfide depressor, and a pH regulator.

Thus, it is seen that extensive measures are taken to minimize the sulfide sulfur content in the fluorspar concentrate, since as stated above the presence of sulfur in acid grade fluorspar is especially objectionable. The effectiveness of the sulfide depressor is therefore critical to achieve a low sulfur content, typically specified as not greater than about 0.02%. Sodium cyanide is known to be highly effective as a sulfide depressor in meeting this specification and has been used in this capacity for many years. However, increasingly stringent evironmental discharge limits have rendered the use of cyanide impracticable in many instances.

The present invention overcomes this limitation by providing an equally effective substitute sulfide depressor for cyanide that is substantially environmentally unobjectionable, namely an alkali metal sulfide such as sodium sulfide. Alkali metal sulfides have conventionally been used primarily as a sulfidizer to aid the flotation of tarnished or oxidized minerals or as a selective depressor in the differential flotation of a mixture of metallic sulfide minerals. In the activator mode, a sufficient amount of an alkali metal sulfide is added to the pulp to form a layer of sulfide ions on the oxidized mineral particles, thereby promoting attachment of anionic collector ions to the mineral surfaces. However, with increasing concentrations of the sulfide ion, the opposite effect results with the sulfidized layer becoming substantial enough to prevent attachment of the collector ions. In the selective depressor mode, it is known that by adding an "excess" amount of sulfide ions (i.e. more than that needed for sulfidizing) and by selectively adjusting the pH of the pulp, a mixture of sulfide minerals can be separated by differential flotation.

Thus, prior use of alkali metal sulfides would indicate their use either in minimal quantities as an activator of oxidized minerals or in excess quantities as a selective depressor in the differential flotation of sulfide minerals with the incidental depression of associated oxidized minerals. In contrast, the present invention utilizes an alkali metal sulfide to depress metallic sulfides while not substantially hindering flotation of the nonsulfide ore fluorspar, thereby providing an effective substitute for cyanide in the flotation of a high grade fluorspar concentrate.

SUMMARY OF THE INVENTION

The invention provides for an improvement in a process for the froth flotation of fluorspar ores containing metallic sulfide accessory minerals to obtain a fluorspar enriched concentrate that is substantially free of sulfide impurities, wherein an anionic collector for fluorspar is utilized in the presence of a depressor for metallic sulfides. The improvement comprises utilizing an alkali metal sulfide as the depressor. The alkali sulfide metal is preferably sodium sulfide.

The invention is especially appropriate in the flotation process for an acid grade fluorspar enriched concentrate having a fluorspar content of at least about 96.5% and a sulfide sulfur content of not greater than about 0.02%, from a fluorspar ore containing, in addition to fluorspar, substantial amounts of gangue minerals and metallic sulfide accessory minerals including the steps of:

(a) comminuting the ore to substantially liberate the fluorspar from the ore;

(b) slurrying and classifying the comminuted ore to produce an aqueous pulp having a solids content of about 35 to 45 wt. % and a solids particle size less than about 48 mesh;

(c) conditioning the pulp with the addition of flotation reagents while heating the pulp, the flotation reagents including a fatty acid fluorspar collector, gangue depressors, the metallic sulfide depressor, and a pH regulator to maintain the pulp in the pH range of about 8.5 to 9.5; and (d) subjecting the conditioned pulp to froth flotation and recovering a froth enriched in fluorspar and substantially free of sulfide sulfur.

The fluorspar collector preferably is oleic acid added to the ore slurry at the rate of about 0.5 to 1.5 pounds per (short) ton of ore (0.25 to 0.75 kg/tonne); the gangue depressors preferably are an alkali metal silicate, starch, and quebracho each added at the rate of about 1 to 5 pounds per ton of ore (0.5 to 2.5 kg/tonne); and the metallic sulfide depressor is preferably added at the rate of about 0.05 to 0.4 pounds per ton of ore (0.025 to 0.2 kg/tonne). The pulp is heated to a temperature of at least about 85° F. (29° C.), preferably about 85° 105° F. (29° to 41° C.), more preferably about 96° to 100° F. (36° to 38° C.).

DESCRIPTION OF THE PREFERRED EMBODIMENTS

The composition of the ores treatable in accordance with the present invention typically are composed of about 30 to 60% fluorspar, up to about 15% metallic sulfide minerals such as galena, sphalerite, pyrite, and chalcopyrite, up to about 55% gangue minerals such as quartz, calcite, and barite, and minor quantities of other impurities. The ore is prepared for froth flotation by conventional methods which typically include the following steps:

The ore is crushed and ground to substantially liberate the fluorspar from the ore, the extent of comminution being determined from the locking characteristics of the particular ore. The fineness of the grind is typically characterized as about 100% minus 48 mesh and 60 to 90% minus 200 mesh. Integral to the comminution process, the ground ore is typically preconcentrated in heavy media separation to remove substantial amounts of gangue.

The ground ore is then slurried with sufficient quantities of water to form an aqueous pulp having a solids content of about 35 to 45 wt. %. The solids contained in the pulp are classified to yield a pulp having a solids particle range suitable for flotation, generally ranging from about 48 mesh to 10 microns.

Next, the pulp is subjected to prefloat operations to remove a substantial portion of the metallic sulfides. The sulfides are froth floated in conventional fashion, typically by xanthates in combination with copper sulfate, and in the presence of a gangue depressors. After prefloat, metallic sulfides in the ore typically constitute less than about 3%.

Next, the pulp is conditioned with the addition of flotation reagents which agitating the pulp and heating the pulp by steam injection to a temperature in the range of about 85° to 105° F. (29° to 41° C.), more preferably about 96° to 100° F. (36° to 38° C.). Conditioning periods typically range from about 5 to 60 minutes. The flotation reagents are typically a fluorspar anionic collector, such as a fatty acid, preferably oleic acid, at the addition rate of about 0.5 to 1.5 pounds per ton of ore (0.25 to 0.75 kg/tonne); gangue depressors, such as an alkali metal silicate, starch, and quebracho each at the rate of about 1 to 5 pounds per ton of ore (0.5 to 2.5 kg/tonne); a pH regulator, such as soda ash, in sufficient quantity to maintain the pulp in the pH range of about 8.5 and 9.5; and the sulfide depressor. All reagents are added at the beginning of conditioning, except the collector which is added stagewise and quebracho which is added towards the end of conditioning. The lower limit on the temperature range is selected according to the minimum temperature at which the fatty acid collector "spreads" or disperses in the pulp. The upper temperature limit is selected according to the economics for heating the particular process.

Finally, the pulp is froth floated by customary mechanical-pneumatic methods, while substantially maintaining the pulp temperature, to produce an enriched fluorspar froth and a tailings product essentially free of fluorspar and containing the sulfide and gangue minerals. The froth may be refloated in one or more cleaning operations and the tailings recycled. The concentrate recovered has a fluorspar content of at least about 96.5% and a sulfur content not greater than about 0.02%.

Sodium cyanide has long been used as the metallic sulfide depressor in such processes due to its high degree of effectiveness in substantially excluding sulfide sulfur from the floated concentrate. Thus, in measuring the effectiveness of the substitute depressor of the present invention having less environmental impact, the performance of sodium cyanide may readily serve as a standard of comparison. The present invention demonstrates that an alkali metal sulfide, such as sodium sulfide, is an effective substitute for sodium cyanide, substantially equalling this industry standard. Of the alkali metals (principally sodium, potassium, and lithium), sodium is preferred because of its minimal environmental impact as demonstrated by its extensive use in water treatment systems. Although the alkali metals are chemical equivalents within the context of the present invention, the suitability of alkali metals other than sodium must be determined on a casewise regulatory basis depending on local environmental discharge limits.

Sodium sulfide has been used successfully in a commercial scale fluorspar flotation process, substantially as described above, for addition rates ranging from about 0.2 to 0.32 pounds per ton of ore (0.1 to 0.16 kg/tonne). In addition to eliminating cyanide hazards, the use of sodium sulfide at the addition rate of 0.2 pounds per ton (0.1 kg/tonne) results in a net cost savings as compared to the use of sodium cyanide at the conventional rate of 0.31 pounds per ton (0.155 kg/tonne), based upon recent prices. Further, the test data below demonstrate that sodium sulfide is effective for addition rates at least ranging from about 0.05 to 0.4 pounds per ton (0.025 to 0.2 kg/tonne), to depress the sulfide sulfur content (column S) in the concentrate to levels substantially below 0.02%. No adverse effect is seen on the fluorspar grade (column F) as this figure of merit substantially exceeds the minimum acceptable content of 96.5%. The extent of recovery (column R) is generally acceptable, being comparable to recovery obtained in cases using cyanide. It is believed that the few anomalous data points regarding recovery are due to imprecision common to small scale metallurgical bench testing wherein huge commercial quantities are scaled down to laboratory quantities.

The tests were conducted substantially according to the flotation procedure given above, with the sulfide depressor added as a 5% aqueous solution. Test series I treated samples from a sulfide prefloat circuit each having a composition of 43.4% fluorspar, 12.34% barite, 1.02% sphalerite, and 0.045% galena, with the balance being silica and calcite. Test series II treated samples having a composition of 40.9% fluorspar, 9.56% barite, 1.89% sphalerite, and 0.28% galena. It is noted that the sulfides were in the activated condition, having been obtained from a prefloat circuit, and thus were more resistant to depression.

| D | F | G | S | R |
|---|---|---|---|---|
| | Test Series I | | | |
| None | 97.76 | 1.83 | 0.320 | 92.28 |
| NaCN, 0.31 (.155) | 98.05 | 1.80 | 0.006 | 89.17 |
| $Na_2S$, 0.32 (.16) | 98.14 | 1.76 | 0.008 | 88.39 |
| $Na_2S$, 0.32 (.16) | 98.16 | 1.79 | 0.005 | 83.14 |
| $Na_2S$, 0.32 (.16) | 97.32 | 2.64 | 0.007 | 95.32 |
| $Na_2S$, 0.05 (.025) | 97.37 | 2.45 | 0.006 | 93.17 |
| | Test Series II | | | |
| None | 98.53 | 1.32 | 0.212 | 86.51 |
| NaCN, 0.31 (.155) | 98.05 | 1.80 | 0.006 | 89.17 |
| $Na_2S$, 0.40 (.20) | 98.15 | 1.75 | 0.006 | 81.47 |
| $Na_2S$, 0.16 (.08) | 98.18 | 1.74 | 0.007 | 86.49 |
| $Na_2S$, 0.08 (.04) | 98.48 | 1.42 | 0.011 | 86.32 |

where:

D=sulfide depressor and addition rate in pounds per ton of ore (kg/tonne).

F=wt. % fluorspar in concentrate.

G=wt. % gangue in concentrate: silica, calcite, and barite.

S=wt. % sulfide sulfur in concentrate.

R = % recovery of fluorspar from ore.

The present invention is applicable to a wide range of fluorspar ores for the flotation of a wide range of concentrate grades. For lesser grades of fluorspar concentrate that may not require as low a sulfide content in the concentrate as is required in acid grades, the invention may be applied with or without a sulfide prefloat operation depending on the particular specification. The grade of the concentrate and its sulfide content will vary according to the sulfide content in the ore, to whether a prefloat is utilized, and to the number of cleaner fluorspar flotations, if any. Thus, it is not a requirement of the invention that an acid grade fluorspar be recovered or that the sulfide content in the concentrate be as low as 0.02%. Although the invention is especially appropriate for acid grade flotation, it is intended that the invention may be applied broadly to effect a substantial depression of accessory sulfides in the froth flotation of fluorspar wherein an anionic collector is utilized.

Although the present invention has been described in conjunction with preferred embodiments, it is to be understood that modifications and variations may be utilized without departing from the principles and scope of the invention, as those skilled in the art will readily understand. Accordingly, such modifications and variations may be practiced within the scope of the following claims:

What is claimed is:

1. A process for the froth flotation of fluorspar ore containing metallic sulfide accessory minerals to obtain a fluorspar enriched concentrate that is substantially free of sulfide impurities, which comprises the steps of:

a. preparing an aqueous pulp of said ore suitable for froth flotation;

b. conditioning the pulp with flotation reagents including oleic acid as a collector for said ore, sodium sulfide as a depressor for metallic sulfides, gangue depressors, and a pH regulator to maintain the pulp in the pH range of about 8.5 to 9.5 while heating the pulp to a temperature in the range of about 85° to 105° F. (29° to 41° C.); and c. subjecting the conditioned pulp to froth flotation and recovering a fluorspar enriched concentrate having a fluorspar content of at least about 96.5 wt. % and a sulfide sulfur content not greater than about 0.02 wt. %;

wherein: said ore includes about 30 to 60 wt. % fluorspar, up to about 3 wt. % metallic sulfides, and up to about 55 wt. % gangue including silica, calcite, and barite;

said pulp has a solids content of about 35 to 45 wt. % with a particle size of less than about 48 mesh;

said gangue depressors are an alkali metal silicate, starch, and quebracho, each added to said pulp at an addition rate of about 1 to 5 pounds per ton of ore (0.5 to 2.5 kg/tonne), and said pH regulator is soda ash;

said oleic acid is added to said pulp at an addition rate of about 0.5 to 1.5 pounds per ton of ore (0.25 to 0.75 kg/tonne); and said sodium sulfide is added to said pulp at an addition rate of about 0.05 to 0.4 pound per ton of ore (0.025 to 0.2 kg/tonne).

2. A process, as in claim 1, wherein said sodium sulfide is added at an addition rate of about 0.2 to 0.32 pound per ton of ore (0.1 to 0.16 kg/tonne).

3. A process, as in claim 2, wherein said pulp is heated to a temperature in the range of about 96° to 100° F. (36° to 38° C.).

* * * * *